United States Patent [19]

Kaneda

[11] 3,942,069

[45] Mar. 2, 1976

[54] DISCHARGE LAMP LIGHTING APPARATUS AND METHOD

[75] Inventor: Isao Kaneda, Otsu, Japan

[73] Assignee: NEC Sylvania Corporation, Tokyo, Japan

[22] Filed: Sept. 9, 1974

[21] Appl. No.: 504,242

[30] Foreign Application Priority Data

Sept. 13, 1973 Japan ..... 48-103407
Sept. 13, 1973 Japan ..... 48-103408

[52] U.S. Cl. ..... 315/99; 315/106; 315/243; 315/244; 315/DIG. 5

[51] Int. Cl.[2] ..... H05B 37/00; H05B 41/23

[58] Field of Search ..... 315/99, 243, 244, 106; 336/83, 178, 212, 96, 177, 179

[56] References Cited

UNITED STATES PATENTS

| | | | |
|---|---|---|---|
| 3,078,429 | 2/1963 | Wiesher | 336/83 |
| 3,255,512 | 6/1966 | Lochner et al. | 336/83 X |
| 3,423,709 | 1/1969 | Lugten | 336/83 |
| 3,663,913 | 5/1972 | Kato et al. | 336/83 X |
| 3,753,037 | 8/1973 | Kaneda et al. | 315/99 |

*Primary Examiner*—John Kominski
*Attorney, Agent, or Firm*—W. G. Fasse; W. W. Roberts

[57] ABSTRACT

A discharge lamp lighting apparatus includes three oscillation circuits. The first comprises a linear inductor and a capacitor connected in series to a power source. The second oscillation circuit is connected across the capacitor and includes a bounce or backswing booster inductor and a voltage responsive switching element connected in series. The third oscillation circuit comprises the bounce inductor and its distributed capacity. The bounce booster inductor has a magnetic core with a shape and of a material providing an abrupt saturation characteristic. The core factor K of the core is small and may have a ratio of the cross sections of the wound to the unwound parts thereof of less than one half. Alternatively, the ratio of the wound part of the core to the unwound part thereof is less than one fourth and a conventional core material may be employed for the core. Further, the peak temperature characteristic such as the first peak of the initial permeability of the core material may be selected in the range of −40°C to +5°C. The core is provided with a small gap to improve lamp starting operation at high temperatures, the gap having conventional as opposed to mirror polished faces.

14 Claims, 23 Drawing Figures

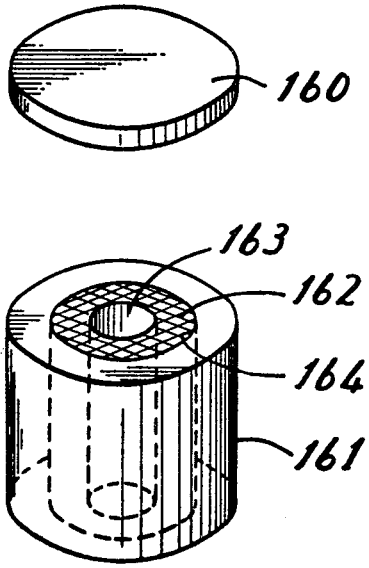
FIG. 12
FIG. 13
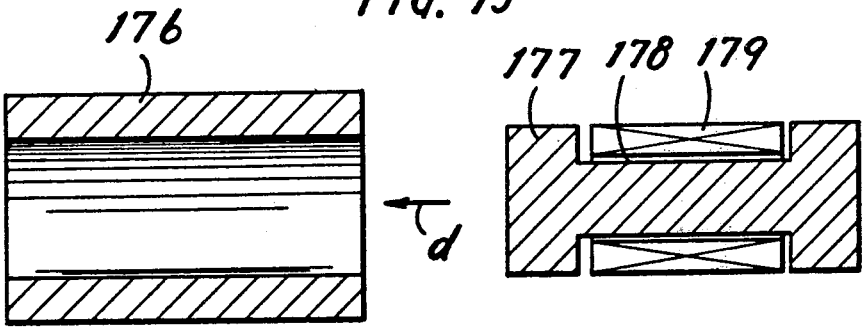
FIG. 14
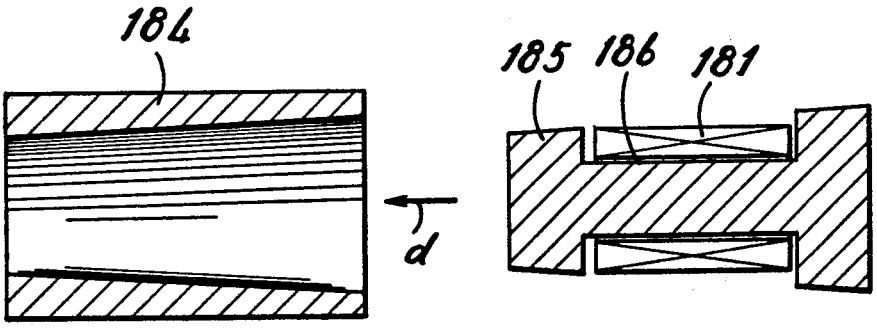

FIG. 15
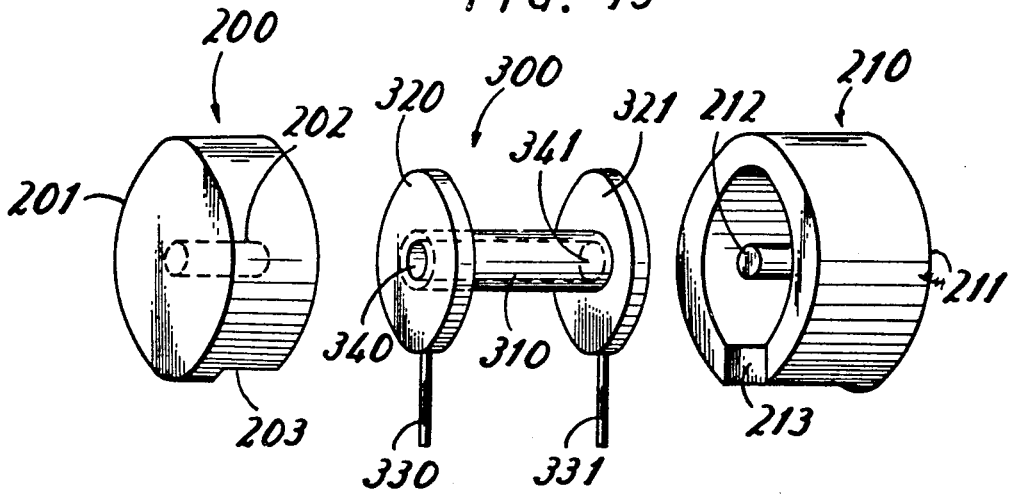
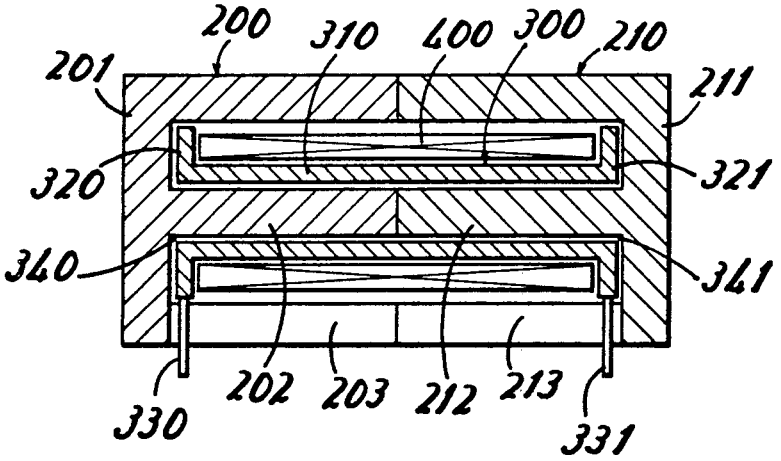
FIG. 16
FIG. 17
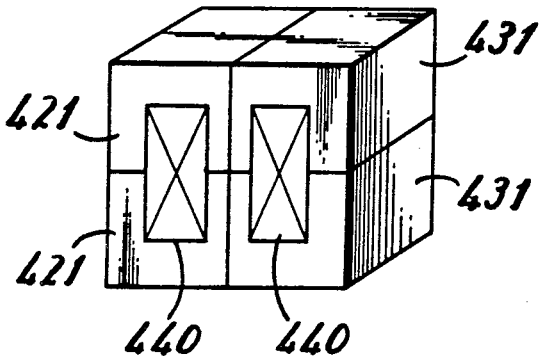
FIG. 18
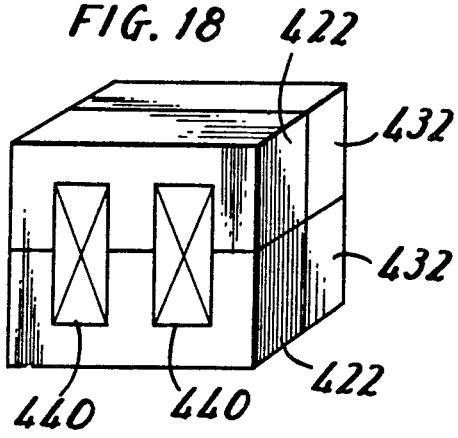

DISCHARGE LAMP LIGHTING APPARATUS AND METHOD

BACKGROUND OF THE INVENTION

The present invention relates to a discharge lamp lighting apparatus and, more particularly, to an improvement in such an apparatus as accomplished by the use of semiconductor devices.

Various discharge lamp lighting circuits have been developed in recent years employing solid state circuits. One such apparatus is described and claimed in U.S. Pat. No. 3,753,037, entitled "DISCHARGE-LAMP OPERATING DEVICE USING THYRISTOR OSCILLATING CIRCUIT," issued Aug. 14, 1973, and assigned to New Nippon Electric Company Ltd.

The apparatus described in the aforementioned patent has some distinct advantages obtained by the use of a thyristor type voltage-responsive switching element such as a (SSS) Silicon Symmetrical Swtich, a (SCR) Silicon Controlled Rectifier, TRIAC or a bidirectional two-terminal diode thyristor, and comprises an oscillator which is implemented by a first oscillation circuit having a power source, a linear inductor and a capacitor connected in series, a second oscillation circuit connected across the capacitor and having a bounce or back swing booster inductor and a voltage-responsive switching element connected to series, and a third oscillation circuit comprising the bounce booster inductor and its distributed capacity, as well as a discharge lamp connected across the capacitor. An oscillation voltage generated across the capacitor is sufficiently high to start or ignite the discharge lamp. As a power source a d.c. or an a.c. source may be employed. Where the discharge lamp is a hot-cathode discharge lamp which has a pair of filaments serving as discharge electrodes, the filaments are generally connected in series with the first oscillation circuit and/or with the second oscillation circuit for the purpose of heating the filaments in a quick manner. As will be described in more detail hereinafter, the maximum instantaneous value of the output voltage of the power source is larger than the brakedown voltage of the switching element apart from a spike pulse or voltage. As a result, the high oscillation voltage generated across the capacitor causes the discharge lamp to be started or ignited, and then the oscillation is stopped and a stabilized discharge operation is maintained thereafter.

In the prior art certain problems have been encountered, for example, in connection with the starting of discharge lamps under different temperature conditions, especially under high and low temperatures. Further, so called half-wave lighting frequently occuring in worn out lamps may also occur prior to the end of the useful life of a lamp and this is to be avoided. These problems will be described in more detail below.

OBJECTS OF THE INVENTION

In view of the above, it is the aim of the invention to achieve the following objects, singly or in combination:

to provide an improved discharge lamp lighting apparatus, especially an improved discharge lamp starting circuit;

to assure a positive starting operation of a discharge lamp and to maintain a stabilized lighting operation irrespective of ambient temperatures;

to provide an improved bounce booster inductor for a discharge lamp lighting circuit; and to provide a less expensive magnetic core for a bounce booster inductor for avoiding an on-off lighting operation due to a spike voltage generated during a lighting operation.

SUMMARY OF THE INVENTION

A discharge lamp lighting apparatus of the present invention comprises a first oscillation circuit having a power source, a linear inductor and a capacitor connected in series, a second oscillation circuit connected across the capacitor and having a bounce or back swing booster inductor and a voltage responsive switching element connected in series, a third oscillation circuit comprising the bounce booster inductor and its distributed capacity, and a discharge lamp connected across the capacitor. The switching element has a breakdown voltage within the range of from above a virtual voltage across the discharge lamp when the lamp remains lighted to below the maximum instantaneous voltage of the power source. The first, second and third oscillation circuits generate a high oscillation voltage across the capacitor for starting or igniting the discharge lamp. The bounce booster inductor comprises a magnetic core and a coil wound thereon.

According to one aspect of the present invention, a preferred geometry of the core for the bounce booster inductor is specifically determined; that is, the magnetic core is so designed that the cross-sectional area of the coiled part is less than one-half of the overall or total cross-sectional area of the non-coiled part, that the magnetic path length of the coiled part is less than one-fourth of the overall magnetic path length, and that the ratio of length to width of a rectangular window part of the core through which the coil is wound is 1 to 2.2 to shorten the magnetic path length. As a result, it is possible, without increasing the cross-sectional area of the coiled part of the core and with a lower number of turns, to increase the inductance of the bounce booster inductor, and thus to improve the starting function in that half wave lighting is prevented at a normal temperature, the spike voltage is blocked at a low temperature, and the starting operation is improved at high-temperatures whereby a core made of a low-permeability grade of ferrite may be used and the size of the bounce booster inductor may be reduced.

According to another aspect of the present invention, the ferrite core of the bounce booster inductor is so made as to improve its effective permeability-temperature characteristics, as compared with that of conventional high-permeability ferrite cores. More particularly, the ferrite core in the form of the inductor L2 has a peak of permeability in the low temperature range from −40°C to +10°C by increasing iron oxide ingredients, employing additional ingredients and/or by modifying the sintering process as will be described in more detail below. As a result, such specially made ferrite core has a higher permeability at low temperatures than that of conventional cores. Hence, it is possible to use a cheaper grade of ferrite instead of the grade of an extremely high permeability which has been deemed to be essential for the core material of the bounce booster inductor used in prior art discharge lamp lighting circuits of this type, and to assure a positive starting of the discharge lamp and to maintain a stabilized lighting operation in spite of an undesired ambient temperature, especially at a low temperature.

According to still another aspect of the present invention, the core of the bounce booster inductor has a gap or an equivalent of 0.5 to 20 micron ($\mu$), and is so designed that the cross-sectional area of the coiled portion is smaller than the sum of the cross-sectional area of the non-coiled portion included in the magnetic path. As a result, starting operation characteristics are also improved in a higher temperature atmosphere.

BRIEF FIGURE DESCRIPTION

In order that the invention may be clearly understood, it will now be described with reference to the accompanying drawings, wherein:

FIG. 1 is a schematic circuit diagram of an oscillator which may be employed in a discharge lamp lighting apparatus in accordance with the present invention;

FIGS. 2A+2B are typical voltage response characteristics of the switching element S comprised in the oscillator of FIG. 1;

FIGS. 3A+3B illustrate the operation of the oscillator of FIG. 1;

FIG. 12 is a perspective view of still a further embodiment of the bounce booster inductor L2 of the present invention;

FIG. 13 is a cross-sectional view of a core of a further embodiment of the bounce booster inductor L2 of the present invention;

FIG. 14 is a cross-sectional view of an alternative core of the bounce booster inductor L2 of the present invention;

FIG. 15 is a perspective view illustrating another alternative core of the bounce booster inductor L2 of the present invention;

FIG. 16 is a cross-sectional view illustrating the embodiment of FIG. 15;

FIGS. 17 to 20 are perspective views each illustrating a further alternative core configuration of the bounce booster inductor L2 which may be utilized in the present starting circuit;

DETAILED DESCRIPTION OF PREFERRED EXAMPLE EMBODIMENTS

Figure 1:
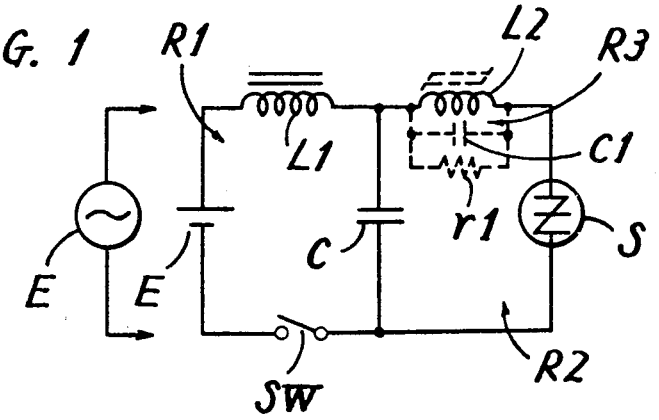

FIG. 1 shows essentially a circuit diagram of the oscillator circuit of U.S. Pat. No. 3,753,037 which is also employed in the present invention. Before going into the detail of the present invention, the construction and operation of said oscillator will first be described to facilitate the understanding of the present invention. A first oscillation circuit R1 comprises a power source E, a linear inductor L1 such as a choke coil or a leakage transformer, a capacitor C and a power switch SW connected in series with a power source E. A second oscillation circuit R2 is formed of a series circuit which comprises a bounce or back swing booster inductor L2 and a bi-directional two-terminal switching element is operative in response to a voltage, and is connected in parallel to the capacitor C. A third oscillation circuit R3 comprises the inductor L2 and its distributed capacity C1. The inductor L2 has such characteristics its inductance decreases with an increase of the current flowing therethrough, and that it is magnetically saturated when the magnetic flux through the core exceeds a certain value. Such characteristics are attainable by the use of a magnetic material such as Mn-Zn type ferrite which is also dielectric.

FIG. 2(A) shows a voltage-current characteristic of a typical bi-directional two-terminal switching element S advantageously used in the oscillator of FIG. 1. FIG. 2(B) shows a voltage-current characteristic of an alternative element S. The characteristics shown in FIGS. 2(A) and 2(B) and elements S having such characteristics are well known to those skilled in the art. The oscillation period of the second oscillation circuit R2 is chosen to be smaller than that of the first oscillation circuit R1 at the moment of saturation of the inductor L2. The distributed capacity C1 of the inductor L2 is shown in FIG. 1 as an equivalent connected in parallel with the inductor L2, while the equivalent loss resistance $r1$ of the inductor L2 is also shown therein connected in parallel with the inductor L2.

FIG. 3(A) shows the voltage $V_C$ generated by the oscillation circuit R2 between both ends of the capacitor C in case a direct current (DC) power source is employed as the power source E.

Figure 4:
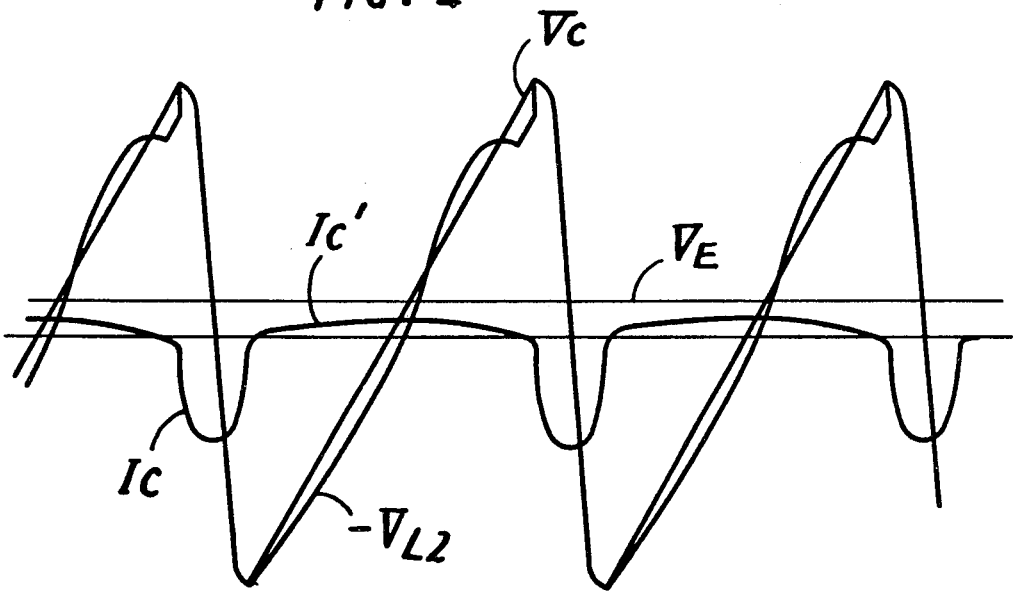
FIG. 4 is a timing diagram illustrating the operation of the oscillator of FIG. 1 on an enlarged time basis.

FIG. 4 shows the relationship of the voltage $V_C$ across the capacitor C, the current $I_C$ through the capacitor C, the output voltage $V_E$ from the DC voltage source E and the bounce or back swing voltage $V_{L2}$ across the inductor L2 on an enlarged scale along the time axis when the oscillation is stabilized.

Referring now to these figures, an initial sequence in the operation of the apparatus involves a charging operation mode in which the switch SW is closed to charge the capacitor C and thus the voltage $V_C$ across the capacitor C, as applied to the switching element S through the inductor L2, increases.

Figure 3:
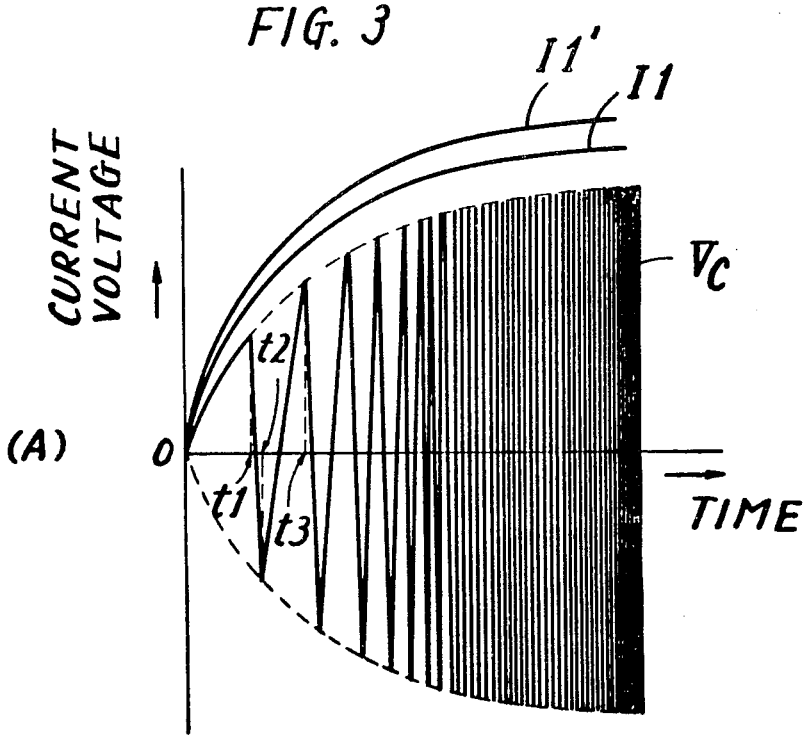
Figure 3:
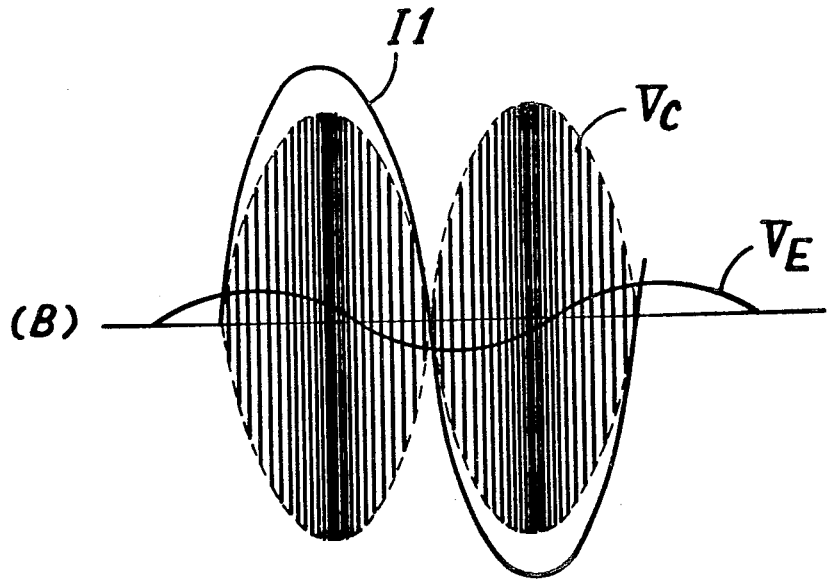

When the voltage $V_C$ has exceeded the breakdown voltage $V_{BO}$ of the switching element S e.g. at the time $t_1$ in FIG. 3 (A), the switching element S is turned on and the capacitor C is discharged since the inductor L2 practically does not have any impedance at such a low frequency voltage variation. In this way, a discharge operation mode begins. The discharge current $I_C$ through the capacitor C increases in a cosine wave pattern with respect to the decrease of the voltage $V_C$, i.e. in a sine wave pattern advanced by about $\pi/2$, and then starts decreasing thereafter (see FIG. 4). The value of the current $I_C$ reaches a very high level due to the saturation of the inductor L2 when the quality factor O of the second oscillation circuit R2 is high. The inductance 1*a* of the saturated inductor L2 is extremely small as compared to its inductance 1*u* at a moment of non-saturation. The current $I_C$ decreases with the progress of discharge of the capacitor C and thus the current I2 through the switching element S decreases. Thus, the current I2 represents the sum of the discharge current IC from the capacitor C and the current I1 through the switching element S when the switching element S is turned on. The current I1 is supplied from the power source E through the circuit of E-L1-L2-S-E. The current I1 in an early stage increases very slowly because of the large inductance of the linear inductor L1 and is small enough to be neglected. Hence the switching element S is turned off when the current I2 has decreased to be smaller than the holding current Ih of the switching element S e.g. at the time *t*2 in FIG. 3(A). While the switching element S is kept on, the electric charge of the capacitor C is transferred and thus the voltage $V_C$ is inverted in polarity to become slightly higher than $-V_{B0}$ because of the voltage drop caused by the resistance *r*1. This, however, does not mean that the switching element S is immediately turned on in an opposite direction. Since, when the switching element S is on, the capacitor C and the distributed capacity C1 of the inductor L2 are connected in parallel, the distributed capacity C1 is at the same time charged to the same voltage in the same polarity as the capacitor C, its voltage thus being about $-V_{B0}$. Thus, the inductor L2 is restored to be in the unsaturated condition when the switching element S is turned off or blocked.

With the switching element S in the off state, a further charging operation mode begins in the first oscillation circuit R1. The initial value of a primary current $I_3$ flowing through the inductor L1 cannot be zero in the further operation mode, which is different from the initial charging operation mode, since the initial value of the primary current $I_3$ is still present immediately before the electromagnetic energy stored in the inductor L1 causes the switching element S to be turned off in the previous discharging operation mode. In addition, the normal current $I_4$ having the same value as in the initial charging operation mode flows to charge the capacitor C. As a result, the current I1 for charging the capacitor C is the sum of both the primary current $I_3$ and the normal current $I_4$. The oscillating operation of the inductor L1 and the capacitor C causes the capacitor C to be charged again, and thus the voltage $V_C$ continues to increase from $-V_{B0}$ through a zero value to and above $+V_{B0}$. Meanwhile, the switching element S is kept non-conductive even if $V_C$ has increased above $+V_{B0}$ in view of the fact that during the previous discharging operation mode electrostatic energy is stored in the distributed capacity C1 of the inductor L2. More specifically, even after the switching element S is turned off and thus the current $I_2$ through the switching element S is cut off and the inductor L2 is restored to be in the non-saturated condition, the electrostatic energy stored in the distributed capacity C1 is transferred, so that the bounce or back swing voltage $V_{L2}$ as shown in FIG. 4 is generated across the inductor L2 in a direction opposite to that of the voltage $V_C$ across the capacitor C and a damped oscillation is started which is caused by the inductance 1*u* in the non-saturated condition of the inductor L2 and the distributed capacity $C_1$, and consequently the terminal voltage of the inductor L2 remains as it is for a relatively long time period which is longer than the time period of *t*2 to *t*3 as shown in FIG. 3 (A).

The direction of the discharge current $I_C$, from the distributed capacity C1 is opposite to that of the discharge current IC of the capacitor C with respect to the inductor L2, and hence the inductor L2 is quickly restored to be in the unsaturated condition. By proper choice of the construction of the inductor L2, it is possible through adjustment of the oscillating operation caused by the inductor L1 and the capacitor C in the first oscillation circuit R1 to assimilate the variation rate of the bounce voltage $V_{L2}$ to that of the terminal voltage $V_C$ caused by recharging of the capacitor C. In such a case the terminal voltage across the switching element S determined by the difference between the voltage $V_C$ and the voltage $V_{L2}$ is kept low for a considerably long time despite the rise of the terminal voltage $V_C$ of the capacitor C. While the bounce voltage $V_{L2}$ attenuates in a damped oscillation, as mentioned above, and as a result thereof a difference voltage between the terminal voltage $V_C$ of the capacitor C and the bounce voltage $V_{L2}$ continues to increase gradually until the difference voltage is equal to $V_{B0}$ and at this moment the switching element S is turned on again. Thus, the charging and discharging operation modes are alternately repeated.

As a result, each time the capacitor C is charged the normal capacitor charging current $I_4$ is added to the primary current $I_3$ through the first oscillation circuit R1, and each time the capacitor C is discharged the primary current $I_3$ passing through the circuit comprising E-L1-L2-S-E continues to increase gradually, whereby the capacitor charging current $I_1$ also continues to increase gradually, so that the time period of the charging operation mode is shortened as the charging is repeated.

Meanwhile, as mentioned above, the value of the primary current $I_3$ flowing through the circuit of E-L1-L2-S-E continues to increase in each discharging operation mode, and the terminal voltage $V_C$ of the capacitor C increases immediately before the switching element S is turned on. Consequently the Current $I_2$ through the inductor L2 increases gradually. As a result, the amount of electrostatic energy stored in the distributed capacity $C_1$ increases and thus the bounce voltage $V_{L2}$ across the inductor L2 which is generated by the oscillation circuit $R_3$ when the switching element S is turned off, also increses.

Thus, the voltage $V_C$ is amplified in the charging operation mode, while the voltage $V_C$ is inverted and the bounce voltage $V_{L2}$ is amplified in the discharging operation mode, with a resultant gradual increase of the voltage $V_C(=V_{B0}+V_{L2})$ until eventually the voltage $V_{L2}$ can follow the voltage $V_C$ at its extreme. In this stabilized condition, the primary current $I_3$ remains constant, and is only slightly lower than that of the current $I_1$ stabilized in the circuit shown in FIG. 1 with the capacitor C eliminated and the switching element S short-circuited. The oscillation period is determined by the voltage $V_C$ under this stabilized condition.

In this way, the operation modes described above are repeated and the circuit shown in FIG. 1 oscillates to provide an alternating current AC output, as illustrated in FIG. 3 (A). Eventually, the oscillation output voltage $V_C$ follows such a pattern that the envelope saturates at a value determined by the circuit constants.

Thus an AC voltage $V_C$ of high frequency is generated across the capacitor C, which is higher than that of the DC voltage source E. In the operative embodiment of the present invention, the oscillation frequency attainable is up to several 10 KHz and the oscillation voltage is up to nearly 10 times the source voltage.

It is to be understood that an AC power source may be used as the power source E in view of the high oscillation frequency. In such a case, as seen from FIG. 3 (B), the envelope of the oscillating output voltage $V_C$ follows a sine curve which is in phase with the AC input current $I_1$, and is out of phase by about 90° with an AC voltage $V_E$ of the AC power source E. Said envelope is symmetrical with respect to the time axis.

It is further to be understood that the abovementioned function is achieved also in case where a capacitor is interposed in series with the linear inductor L1 and thus the interposed capacitor and the linear inductor L1 cooperate as a so-called advanced-phase current-limiting circuit.

The discharge lamp lighting apparatus of the present invention utilizes the high voltage oscillation output $V_C$ generated across the capacitor C in the oscillating circuit shown in FIG. 1.

Figure 5:
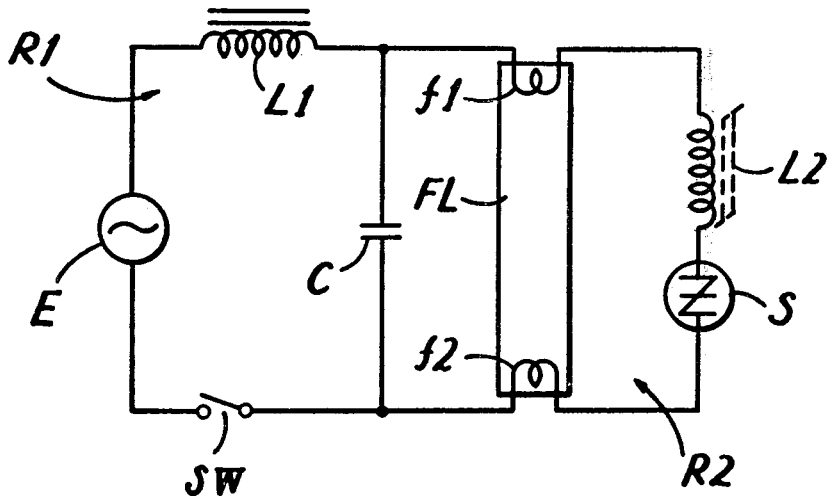
FIG. 5 is a schematic diagram of a discharge lamp lighting apparatus of the present invention.

FIG. 5 shows such an apparatus according to the invention for lighting a single discharge lamp FL. The discharge lamp FL is connected across the capacitor C with its filaments f1 and f2 connected in series with the second oscillation circuit R2. The essential features of the oscillator are the same as that of the circuit shown in FIG. 1, and therefore the same parts are designated by the same reference characters. For the purpose of simplicity, however, the third oscillation circuit R3 is not shown in FIG. 5.

Figure 2:
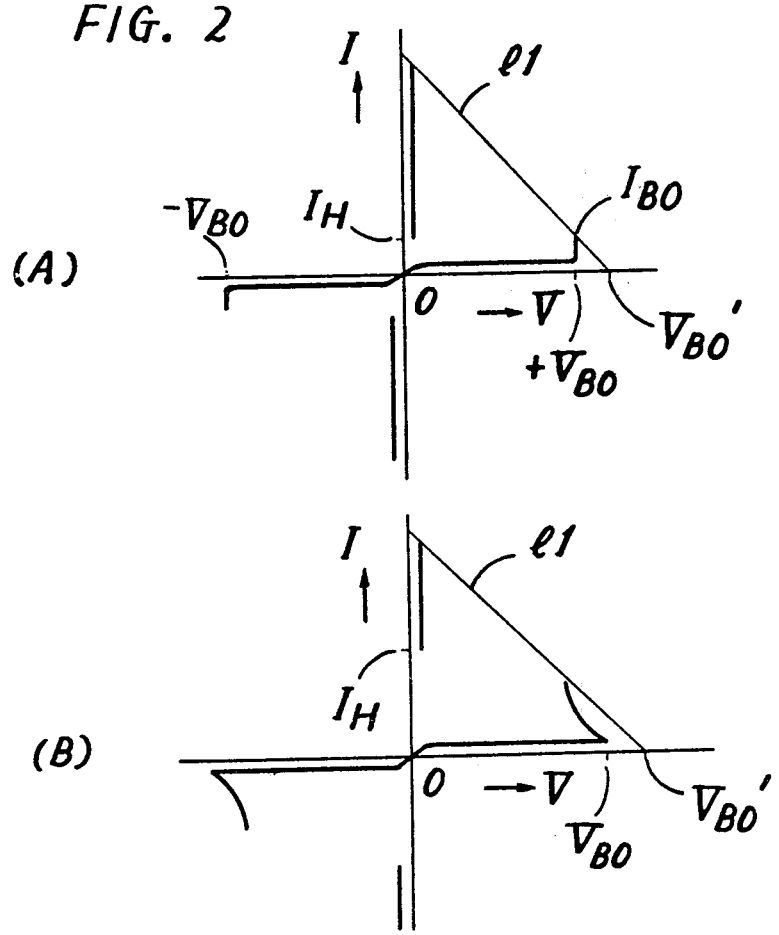

In FIG. 2 load curves 1 are shown additionally for better understanding of the operation of the circuit shown in FIG. 5. Therefore, the operation of the circuit shown in FIG. 5 will be described in the following with reference to FIG. 2.

The maximum voltage $V_{MAX}$ of the output from the power source E, the peak value $V_{FL}$ of the voltage applied across the discharge lamp FL, hereinafter referred to as "spike voltage $V_{FL}$," the breakdown voltage $V_{BO}$ of the switching element S and the effective breakdown voltage $V_{BO}$, of the switching element S during the lighting operation of the discharge lamp FL are chosen so as to meet the following relationships.

$$V_{MAX}>V_{BO} \text{ and } V_{BO}'>V_{FL}$$

In the embodiment of FIG. 5, the AC power source E is employed having the normal line voltage frequency. Thus, the impedance of the inductor L2 is almost negligibly small at the time of starting of the discharge lamp FL. Because of the relationship $V_{MAX}>V_{BO}$, oscillation is started with turning on of the power switch SW and accordingly a high voltage $V_C$ is generated across the capacitor C. Meanwhile, the filaments *f*1 and *f*2 of the discharge lamp FL are preheated by a large amount of high frequency oscillation current through the second oscillation circuit R2. After sufficient preheating of the filaments *f*1 and *f*2 the discharge lamp FL is started or turned on by applying the high oscillation voltage, and then the oscillation is terminated because of the relationship $V_{BO}'>V_{FL}$, and the discharge lamp FL continues discharging. When the discharge lamp FL remains lighted, the inductor L1 performs the function of a conventional choke coil, while the capacitor C serves as a noise eliminator.

In commercializing the apparatus shown in FIG. 5, however, there are quite a number of problems that have to be overcome. In the following, therefore, such problems will be discussed together with techniques proposed for their solution by the present invention.

One problem relates to the spike voltage $V_{FL}$ under low temperature condition: When the discharge lamp FL is left on, the peak value of a voltage across the discharge lamp FL, which is referred to as a spike voltage $V_{FL}$ hereinafter, tends to increase at a low temperature, so that the second oscillation circuit R2 is enabled to oscillate and thus the discharge lamp FL would repeat an on-off lighting operation. Such erroneous operation due to the spike voltage $V_{FL}$ must be eliminated. More specifically, the spike voltage $V_{FL}$ tends to increase when the lamp FL is lighted in a cold atmosphere, which is aggravated with the increase of the capacitance of the capacitor C connected in parallel with the discharge lamp FL. As the discharge lamp FL is lighted, the spike voltage $V_{FL}$ is applied to the switching element S through the inductor L2 and, when it exceeds the breakdown voltage $V_{BO}'$ of the switching element S, the switching element S is turned on and the discharge lamp FL goes out with its opposite discharge electrodes or filaments *f*1 and *f*2 short-circuited, and then it is lighted again, resulting in an on-off lighting operation of the lamp FL. In a low temperature atmosphere, therefore, it is essential to raise the effective breakdown voltage $V_{BO}'$.

Such an undesired operation, however, can be avoided with the apparatus illustrated in FIG. 5, which is so designed that the increase of the spike voltage $V_{FL}$ is automatically accompanied by a matching increase of $V_{BO}'$. More specifically, the spike voltage $V_{FL}$ at a low temperature is of a high frequency $f_h$, say approximately 1.5 kHz, and the impedance $(2\pi f_h 1_u)$ of the inductor L2 is accordingly high. 1u is the inductance of the inductor L2 in a non-saturated condition. As described earlier, the load line *l*1 shown in FIG. 2(A) indicates the impedance $2\pi f_h 1_u$ at a given spike voltage $V_{FL}$. When the impedance $(2\pi f_h 1_u)$ rises, the load line *l*1 shifts toward the right direction on the coordinate shown in FIG. 2(A), and thus the point of intersection between the load line *l*1 and the voltage axis V also shifts toward the right. The point of intersection designates the effective breakdown voltage $V_{BO}'$ which is accordingly so high that the relationship $V_{BO}'>V_{FL}$ is satisfied even when the spike voltage $V_{FL}$ is very high. When the effective breakdown voltage $V_{BO}'$ is sufficiently high, it is possible to use a trigger diode as the switching element S whose typical characteristic is shown in FIG. 2 (B).

Depending on the type of the discharge lamp FL, however, the spike voltage $V_{FL}$ can be extremely high, and thus in order to enable lighting in a low-temperature range, it is advisable further to raise the effective breakdown voltage $V_{BO}'$. Since the inductance 1*u* is proportional to the effective permeability $\mu e$, it is desirable to choose a core the effective permeability $\mu e$ of which is higher at a lower temperature. However, existing or commercially available high permeability ferrite such as Mn-Zn type ferrite has characteristics, as shown by curves *a* and *b* in FIG. 9 in which the permeability is higher at a normal temperature than at a lower temperature. As a result, the inductance of the inductor L2 employing such existing ferrite is much higher at a normal temperature. However, such a high permeability material is usually expensive.

Another problem exists in connection with half-wave lighting by which is meant a condition in which the discharge current is rectified which flows through the discharge lamp FL while it is lighted. With a fluorescent lamp approaching the end of its life time, for example, the condition of half-wave lighting is eventually inevitable as generally one of the discharge electrode filaments is liable to have its emission reduced earlier than the other. However, it gives rise to a real problem if this condition of half-wave lighting occurs in a relatively new discharge lamp, or at an earlier time of the performance curve of the discharge lamp FL as would normally be expected.

The reason for the half-wave lighting will now be described. When the oscillation voltage $V_C$ has been generated to be higher than the starting voltage in normal operation of the discharge lamp FL and before a sufficient rise of the temperature of the filaments *f*1 and *f*2, the discharge lamp FL is started or ignited during one half period of the output from the AC power source E, with the higher temperature filament serving as a cathode while the lower temperature filament serves as an anode. Only during the other half period of the AC power source output, oscillation occurs and reduces the filament preheating current by one half whereby an insufficient filament temperature is caused. Half-wave lighting is, therefore, caused more frequently when the atmospheric temperature is normal and thus the starting voltage is low, than when the temperature is low or high and thus the starting voltage is high.

To prevent this condition of half-wave lighting it is required to increase the filament preheating current. For this purpose it is necessary to increase the capacitance of the oscillation capacitor C and to decrease the unsaturated inductance 1u of the inductor L2 when oscillation is maintained. Such an arrangement, however, inevitably results in an increase of the spike voltage $V_{FL}$ when the temperature is low, and this is contrary to the above-mentioned requirement for the reduction of the spike voltage $V_{FL}$. When the capacitance of the capacitor C as well as the inductance 1u of the inductor L2 is kept constant, the risk of half-wave lighting can be reduced by decreasing the voltage $V_s$ across the inductor L2 in a saturation condition thereof because of the resultant increase of the oscillation duration in each half period or cycle of the AC power source output having the normal line frequency for example 50 or 60 Hz. If the material of the core of the inductor L2 is the same one that is used for avoiding the on-off operation due to the spike voltage $V_{FL}$, the saturation voltage $V_S$ is dependent, in turn, upon the number of turns of the coil and the crosssectional area of the coiled part: the smaller the latter, the lower the former. The approach of lowering the permeability of ferrite at a normal temperature is perfectly harmless as a countermeasure for half-wave lighting, since it is accompanied by a decrease of the inductance 1u of the inductor L2.

Yet another problem exists in starting a discharge lamp in a high-temperature atmosphere. The starting voltage of the discharge lamp FL such as a fluorescent lamp is known to increase rapidly as the ambient temperature exceeds 50°C. When lighting is maintained in such a high-temperature atmosphere, the temperature of the body of the discharge lamp FL is liable to be still higher. Further, the maximum magnetic flux density $B_m$ of the ferrite core of the inductor L2 decreases with the increase of the ambient temperature, whereby the magnetic flux density change $\Delta B$ also decreases thereby causing a drop of the oscillation output voltage across the capacitor C. Such being the case, it is essential for an improved safety in high temperature starting to carefully study the extent of the magnetic flux density change $\Delta B$ of the ferrite material. A well-known approach is to provide a large difference between the maximum magnetic flux density $B_m$ and the residual magnetic flux density $B_r$, or to provide a very small gap in the ferrite core of the inductor L2 for decreasing the apparent residual magnetic flux density $B_r$ since the high permeability material has such characteristics that the Curie point is comparatively low and the maximum magnetic flux density $B_m$ at a high temperature is also low. When the maximum magnetic density $B_m$ is constant, an increased saturation voltage $V_s$ of the inductor L2 results in an easier lighting. Hence, lighting is easier when the number of turns N and thus the inductance of the inductor L2 is greater. When, on the other hand, the saturation voltage $V_s$ is constant, decreased leakage magnetic flux of the inductor L2 results in easier lighting. Moreover, from the standpoint of the material for the core of the inductor L2, it is preferably of lower residual magnetic flux $B_r$ and lower hysteresis loss at a high temperature.

The underlying principle for the design of the core form in this connection is to raise the starting capability to the highest possible level for a given saturation voltage $V_s$, i.e. without increasing the saturation voltage $V_s$, which is liable to cause an increased risk of half-wave lighting. For high temperature starting it is rather advantageous to reduce the ferrite's permeability. The reason is that, while a material of high permeability has a low Curie temperature and, its maximum magnetic flux density $B_m$ being small at a high temperature, has little margin with regard to the high-temperature starting characteristic. A reduced permeability means an increased Curie temperature and a resultant increase of the maximum magnetic flux density $B_m$ and hence by the use of a material of lower permeability an increase in oscillation output voltage $V_c$ in a high temperature atmosphere may be achieved.

In accordance with the teachings of the present invention, the core material and geometry for the bounce booster inductor L2 as shown in FIG. 5 are determined as follows. For preventing an on-off lighting operation of the discharge lamp FL, it is essential to block the spike voltage $V_{FL}$ with an inductor L2, and for successful blocking of the spike voltage $V_{FL}$ the impedance $2\pi fh \cdot u$ of the inductor L2 in its unsaturated condition should be sufficiently high. The equivalent inductance 1u of the inductor L2 when the lamp FL is "on" (lighted), is shown by the following equation:

$$1u = \frac{4\pi\mu e \cdot N^2}{K} \times 10^{-9} \text{ (Henry)} \qquad (1)$$

wherein $\mu e$ is the effective permeability of the core, $N$ is the number of turns of the coil, and $K$ is the core factor which is determined as follows:

$$K = K_1 + K_2 = \frac{le}{Ae} = \sum_i \frac{li}{Ai} \qquad (2)$$

$K_1$ is the core factor of the coiled part of the core for the inductor $L2$, and $K_2$ is the core factor of the non-coiled part of the core for the inductor $L2$. The core facotr K is obtained by dividing the effective magnetic path length $le$ by the effective cross-sectional area Ae of the core of the inductor L2. It can also be determined by first obtaining a ratio with the cross-sectional area A$i$ at a given point in a closed magnetic path of the core of the inductor L2 as denominator and the length $li$ of the magnetic path having the cross-sectional area A$i$ as numerator, and then integrating over the entire periphery of the closed magnetic path.

From the equations (1) and (2) it is understood that even if the effective permeability $\mu e$ and the number of turns N of the coil are constant, it is possible to increase the equivalent inductance $lu$ by decreasing the core factor K. In other words, it is possible to decrease the effective permeability $\mu e$ and the number of turns N to such an extent that the desired equivalent inductance 1u can be attained. In fact, this is highly effective for precluding the risk of half-wave lighting.

Avoiding half-wave lighting can be ensured according to the invention by increasing the amount of the filament preheating current, which in turn can be accomplished by decreasing the saturation voltage $V_S$ of the inductor L2. This saturation voltage $V_S$ is roughly represented by the following equation (3).

$$V_S = \frac{4}{\pi} NAe\omega \cdot \Delta B \cdot 10^{-8} \text{ (Volt)} \quad (3)$$

where: $Ae$ is the effective cross-sectional area of the core, $\omega$ is the angular velocity corresponding to the oscillation frequency and $\Delta B$ is the change of the magnetic flux density of the core.

From this equation (3) it is apparent that the saturation voltage $V_S$ can be decreased by decreasing N and Ae. The effective cross-sectional area Ae of the core is set at as small a value as possible according to the principle of this type of oscillation circuit. However, the value may not be smaller than that which might result in shorting of the oscillating energy. A better solution of the problem of half-wave lighting, therefore, is to decrease the number of turns N of the coil, reducing the core factor K, which is very useful and advantageous.

Reduction of the core factor K is also advantageous for starting of the discharge lamp FL in high temperature surroundings. If, for a given fixed cross-sectional area, the core factor K is reduced, it has the effect of a markedly larger cross-sectional area of the non-coiled portion as compared to that of the coiled part of the core. Such a form of the core facilitates the operation of the inductor L2 as a saturable choke coil, due to the fact that it decreases the opportunity for the leakage flux of the inductor L2 to interlink the coil, whereby an increased momentary oscillating energy is achieved thus improving the high temperature starting capability.

Figure 6:
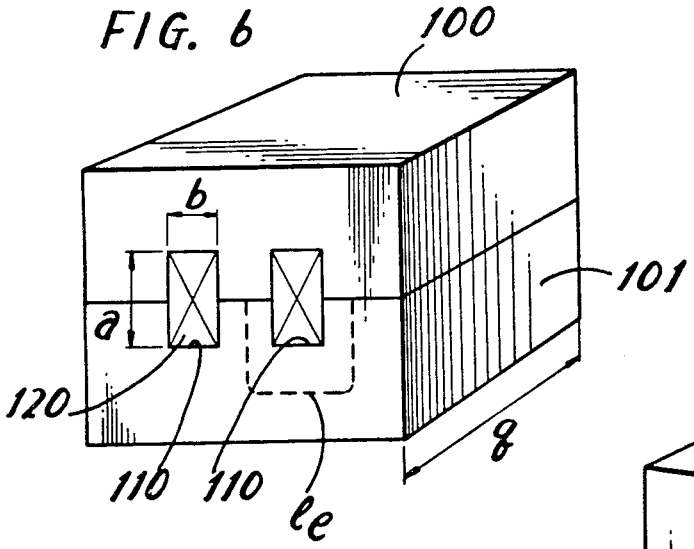
FIG. 6 is a perspective cross-sectional view illustrating an embodiment of the bounce booster inductor L2 according to the invention which may be utilized in the apparatus of the present invention.

FIG. 6 is a diagrammatic perspective view of an embodiment of the inductor L2 according to the invention, wherein a coil 120 is arranged in windows 110 formed of E-section cores 100 and 101. The coil arrangement is, e.g., of the shell-type.

According to the invention, the core factor K is reduced as follows. First, for decreasing the effective magnetic path length $le$ in the equation (2), the rectangular window or hole 110, in which the coil is arranged, is made as small as possible. The height $a$ and the width $b$ of the window 110 are selected so that the length $2(a+b)$ is roughly proportional to the effective magnetic path length $le$ and so that it is smallest when $a=b$, since the product of $a \times b$ is roughly determined by the size of the coil 120.

With commercial, standardized cores 100 and 101, the height/width ratio $a/b$ of the window 110 in which the coil 120 is arranged is more than about 2.4, but according to the present invention, said ratio $a/b$ is to be as close to unity as possible, and is preferably in the range of 1 to 2.2. The core so formed as described above avoids an on-off operation due to the spike voltage $V_{FL}$ and half-wave lighting. In addition the present core is miniaturized.

Secondly, another approach for decreasing the average magnetic path length $le$ is to increase the thickness $q$ of the window 110 through which the coil 120 is arranged. By doing so it is possible to reduce the length $2(a+b)$ corresponding to the effective magnetic path length $le$ for the coiled part of any cross-sectional area or the effective magnetic path length itself.

Thirdly, still another approach for decreasing the core factor K is to increase the denominator $Ae$ in the equation (2). The effective cross-sectional area $Ae$ in a closed magnetic path of the core of the inductor L2 is represented by the following relationship:

$$Ae = f(A_1 \cdot A_2) \quad (4)$$

where $A_1$ is the cross-sectional area of the coiled part, and $A_2$ is the cross-sectional area of the non-coiled part of the inductor L2. The value $a_1$ cannot be increased, for otherwise the risk of half-wave lighting is increased. However, the value $A_2$ can be increased without increasing said risk and hence it is possible safely to increase $Ae$ by increasing $A_2$, while keeping $A_1$ constant. The advisability of this third approach with regard to the discharge lamp starting operation in a high temperature atmosphere may be apparent from the foregoing description.

Thus, with the core of the present invention the core factor K has been reduced to 20–70 percent as compared to that of a conventional inductor of the same cross-sectional area of the coiled part A1. This result means that it is possible to use a ferrite material of a grade that is much lower in permeability and hence less expensive.

In the above example A1 was kept constant. However, this does not mean that the cross-sectional area A1 of the coiled part must necessarily be fixed, since the core dimensions rather than the core factor K alone may be considered.

The form of the core according to the present invention is characterized primarily in that the cross-sectional area A1 of the coiled part is made smaller than the cross-sectional area A2 of the noncoiled parts for overcoming the risk of half-wave lighting. The ratio (A1/A2) is determined to be as small as possible, but at least it should be 1/2 or less in view of such practical considerations as that the core's volume increases with a decrease of said ratio. This results in a progressive increase of cost and when the ratio is more than 1/2, virtually the advantage of using a cheaper grade of core material is lost.

Secondly, the present core is characterized in that for shortening of the effective magnetic path length $le$ the proportion of the length of the coiled part of the magnetic path length is set to be 1/4 or less, since if this ratio 1/4 is exceeded, the form of the window departs from the ideal square which is contrary to the desired diminishing of the core factor. Where necessary, the coiled part is so formed that its cross-section is rectangular whereby the dimension $q$ in the direction of core thickness is larger than that in other directions.

Figure 7:
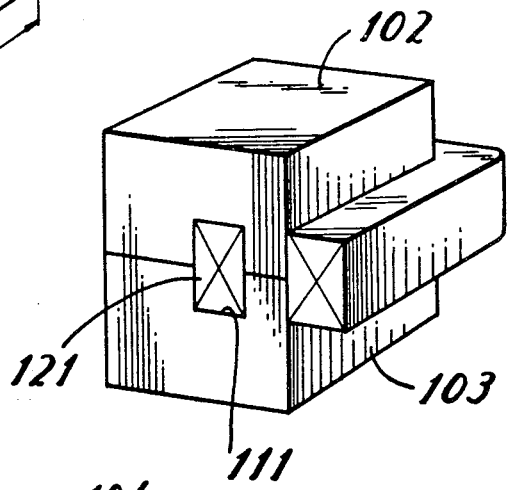
FIG. 7 is a perspective cross-sectional view illustrating another embodiment of the bounce booster inductor L2 of the present invention.
Figure 7:
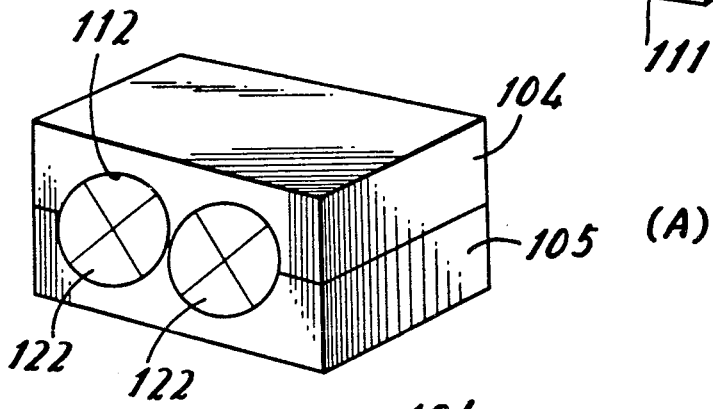

FIG. 7 is a diagrammatic perspective view of the inductor L2 of another embodiment of the present invention, wherein a coil 121 is wound around the narrowed parts of the U-shaped cores 102 and 103 and through a window 111. The technical requirements of the core shown in FIG. 7 are substantially the same as those for the embodiment of FIG. 6. As seen from FIG. 7, a portion of the cores 102 and 103 surrounding the coil 121 is less than that of the embodiment of FIG. 6, that is, more than one-half of the coil 121 is outside the window 111 and thus outside of the cores 102 and 103. As a result, the size of the cores 102 and 103 has to be increased so that the same characteristics can be obtained as in the embodiment of FIG. 6 according to the present invention. For that reason, a pot-type core form as described hereinafter with reference to FIG. 12, for example, is preferred since the pot-type core surrounds entirely the coil.

Figure 8:
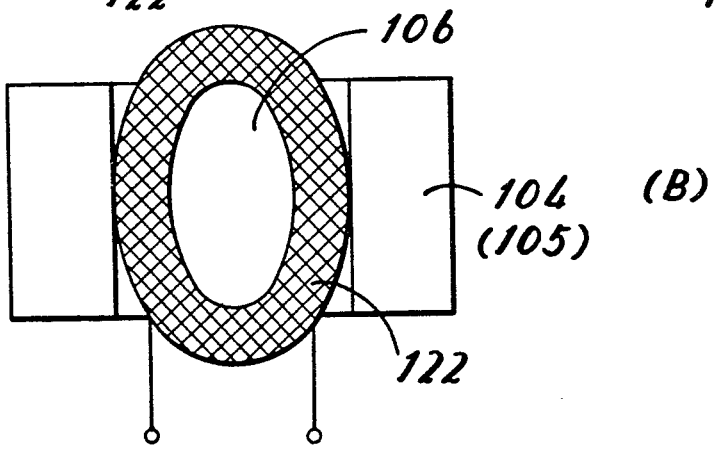
FIG. 8 is a perspective cross-sectional view illustrating a further embodiment of the bounce booster inductor L2 of the present invention.

FIG. 8 (A) is a diagrammatic perspective view of still another embodiment of the present invention characterized particularly in that the windows 112 through which the coil is arranged are not rectangular but roughly round and hence the average magnetic path length $le$ surrounding the round windows 112 is smaller than in the aforementioned embodiments where the cross-sectional area of the window 110 shown in FIG. 6 is the same as that of 112. FIG. 8 (B) shows a contact face of the core 104 or 105. As seen from the figures, the cross-section of the coiled part 106 is practically oval with a loop coil 122 formed around it. An elliptical or circular cross-section of the coiled part 106 allows a reduction of the length of a coiled wire per turn.

Referring again to FIG. 5, from the equation (1) or (2) it appears that the fastest possible increase of the effective permeability $\mu e$ of the core of the inductor L2 is desirable. The lower the temperature is, the larger becomes the spike voltage $V_{FL}$. Hence, the core the effective permeability $\mu e$ of which becomes larger at low temperatures is suited for the inductor L2.

Figure 9:
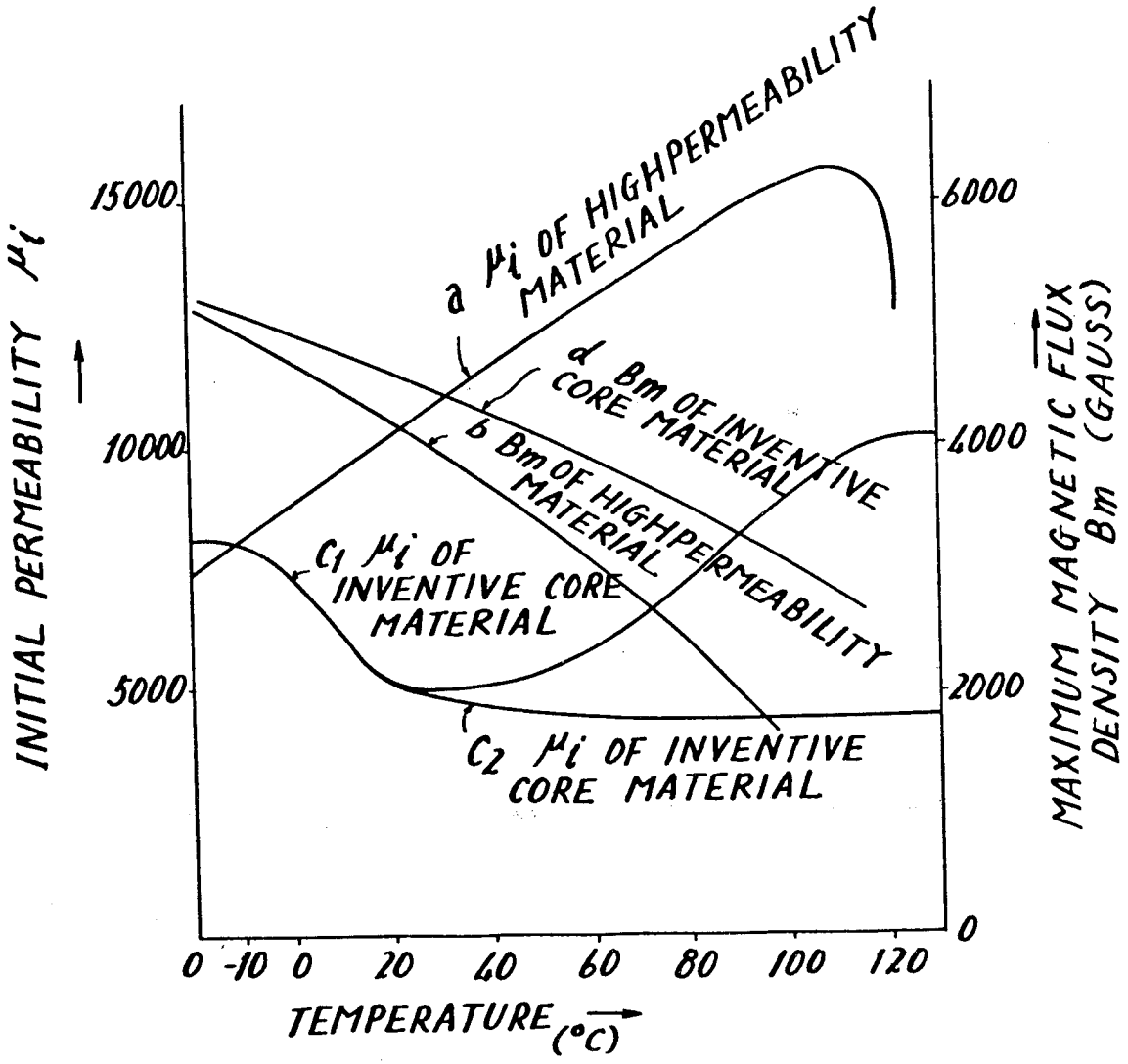
FIG. 9 is a temperature characteristic diagram of a conventional core and the inventive cores of the bounce booster inductor L2.

The curves c1, c2 and d in FIG. 9 indicate the temperature characteristic of the core of inductor L2 which can be employed according to the present invention. The initial permeability $\mu i$ corresponds to the effective permeability $\mu e$. In the figure the curves $c1$, $c2$ and $d$ show the typical initial permeability $\mu i$ and the characteristic of the maximum magnetic flux density $Bm$ of ferrite suitable for inductor L2. The ferrite of this kind can be obtained by means well-known in the ferrite industry, for example in case of the Mn-Zn type ferrite by using a molar ratio of $Fe_2O_3$ in the range of 50–55 percent.

The following will describe the effects produced by such ferrite for the present use. First, in order to block the spike voltage $V_{FL}$, the initial permeability $\mu i$ at a low temperature is high. Accordingly, the effective permeability $\mu e$ is also high, so that the inductance 1u of inductor L2 in its non-saturated state is increased. For that reason and because of the high frequency of said spike voltage $V_{FL}$, the impedance $2\pi fhlu$ of inductor L2 becomes very high, and thus the effective breakdown voltage $V_{BO}'$ of switching element S becomes very high. Hence, the spike voltage $V_{FL}$ can be surely blocked or obstructed, and the erroneous performance of the switching element S can be prevented whereby an undesired on-off operation of discharge lamp FL is also prevented.

Secondly, in order to avoid the half-wave lighting, the ferrite core is so made that compared with the ferrite in general the curves $c1$ and $c2$ show a lower initial permeability $\mu i$ at a normal temperature than at a low temperature. The relation between the oscillation frequency $f$ of the oscillation circuit $R_2$ and the non-saturation inductance $lu$ of the inductor L2 when the circuit oscillates is indicated by the following equation (5):

$$\alpha^{fa} \frac{1}{\sqrt{lu}} \qquad (5)$$

Accordingly, the decrease of initial permeability $\mu i$ or effective permeability $\mu e$ at a normal temperature means a decrease of the inductance $lu$ and a rise of the oscillation frequency $f$ at a normal temperature. When the oscillation frequency $f$ rises, the filament preheating current is increased causing the temperatures of the filaments $f1$ and $f2$ to become sufficiently high and half-wave lighting is made more difficult.

The half-wave lighting tends to occur readily with the increased saturation voltage $V_S$ of inductor L2. As mentioned before, the saturation voltage $V_S$ is given by the equation (3). By improving the spike voltage blocking capability the number of turns of windings N can be decreased and in such cases the saturation voltage $V_S$ of inductor L2 is decreased, the inductance $lu$ at a normal temperature is decreased therewith and therefore the filament preheating current is further increased, causing the half-wave lighting to take place with even more difficulty.

Thirdly, in order to raise the Bm at a high temperature in relation to the starting operation of the discharge lamp FL at a high temperature, the ferrite for such use is so made that its Curie temperature is higher than that of the conventional ferrite used herein. As a result, the characteristic of the maximum magnetic flux density is raised, as seen from the curve $d$ compared with the curve b of conventional type ferrites, and thus $\Delta B$ is raised. Hence, the output voltage at a high temperature is increased and the starting operation at a high temperature is facilitated. Regarding the initial permeability $\mu i$, some diversity of the characteristic falling in the region defined by the curves $c1$ and $c2$ is permissible. In case the Curie temperature is high, a curve such as $c2$ is obtained and in case the Curie temperature is relatively lower, a curve such as cl is obtained. Regarding the initial permeability $\mu i$, so long as the required B is obtained, it is good to obtain values over $\mu i$ at normal temperatures.

Figure 10:
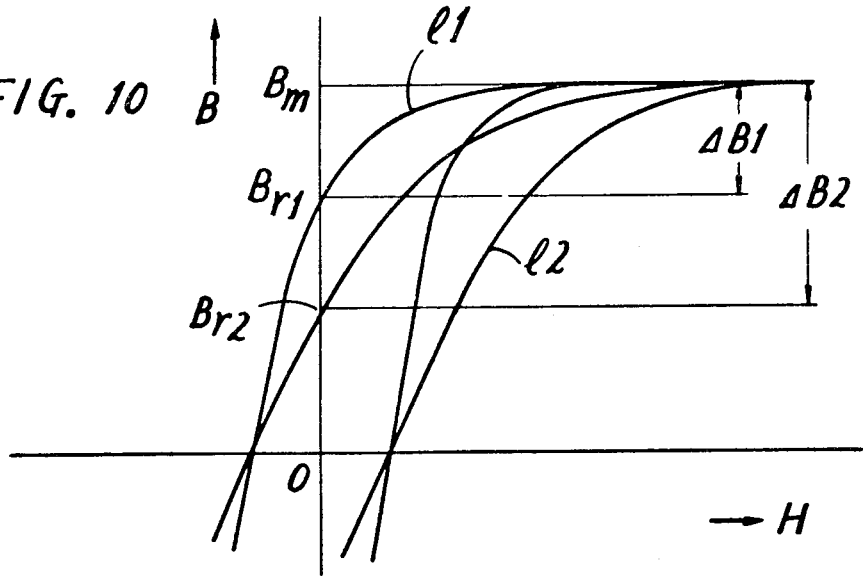
FIG. 10 illustrates the magnetic flux density B as a function of the magnetic intensity of a core of a bounce booster inductor L2.

In case of the ferrite for such use the level of the initial permeability $\mu i$ on the whole is decreased except at a low temperature compared with highly permeable materials. However, this is not a difficulty particularly since the effect of inductor L2 is to work as inductance and a decrease of $\mu i$, i.e. $\mu e$ can be compensated, by designing the shape of the core as mentioned above. Regarding the abovementioned decrease of the core factor, the provision of a gap for improving the high temperature starting operation, which will be described below, serves to compensate for a decrease in the inductance lu. That is, regarding the high temperature starting operation, it is necessary to increase the amplitude of the oscillating output voltage $V_c$, since the starting voltage of discharge lamp FL is raised at a high temperature as mentioned above. However, ferrite decreases its maximum magnetic flux density Bm at a high temperature, change ΔB of magnetic flux density given by the difference between the maximum magnetic flux density Bm and the residual magnetic flux density Br is made small and the amplitude of oscillation voltage $V_c$ is rather decreased. Accordingly, the present invention provides the magnetic core having the characteristic curve B-H such as the curve *l1* in FIG. 10, with a small air gap or equivalent to obtain the characteristic curve B-H sloped as the curve *l2* in FIG. 10 and thereby increases the change ΔB of the magnetic flux density from the existing ΔB1 to ΔB2.

As a result, the h steresis loss arising on the occasion of tracing of the curve B-H is decreased. Hence, the value of the equivalent resistance r1 of inductor L2 shown in FIG. 1 is increased and the amplitude of the oscillation voltage $V_c$ is raised. This effect is prominent when the inductance of inductor L2 becomes lower than 90% of that of the conventional inductor.

Figure 11:
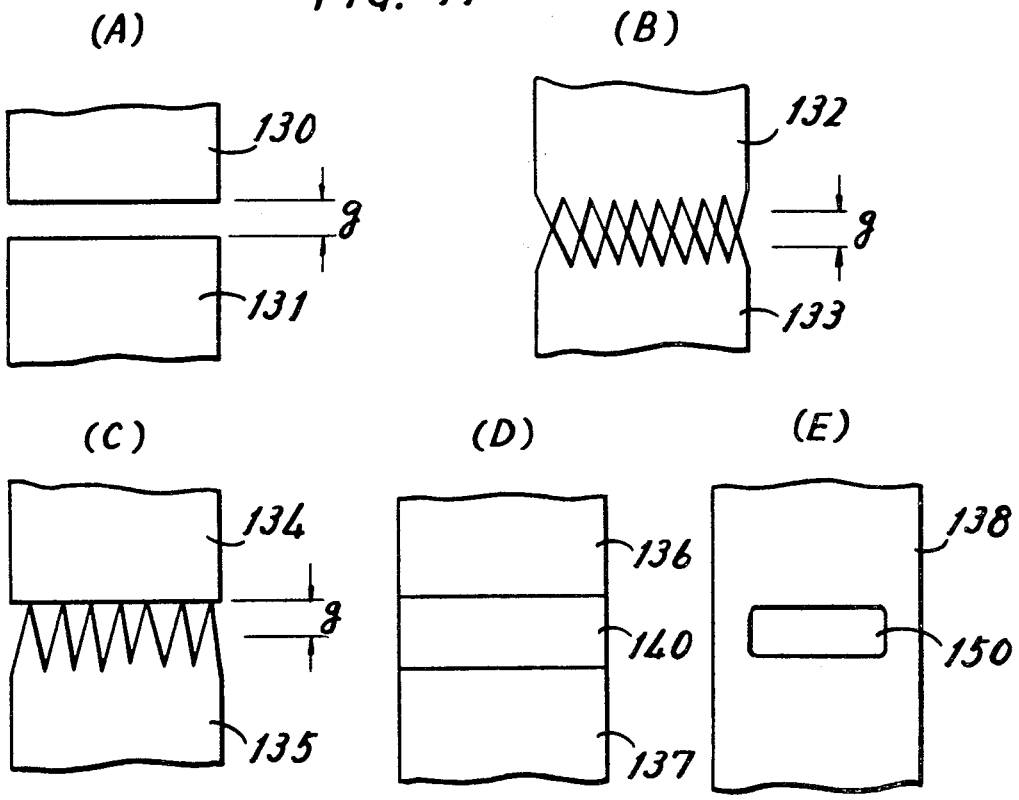
FIGS. 11A to 11E are diagrammatic views partially illustrating the basic features of cores of the bounce booster inductor L2 of the present invention.

For that purpose the following approach is taken according to the invention:

FIG. 11 (A) shows how the opposing faces of cores 130 and 131, which are ground in a mirror face manner, are provided with a gap between them. The conventional type has its opposing faces directly touched without forming any gap, while the invention provides the gap on purpose. The proper size of the gap *g* is in the range of 0.5 to 20μ. The size of approximately 1 to 6μ is the most desirable size, since too small a gap brings about only a little improving effect compared with the conventional type and too large a gap makes the inductance too small to attain the necessary oscillation voltage $V_c$.

FIG. 11 (B) shows how the cores 132 and 133 having their faces roughened with abrasives, are contacted with proper roughness whereby the gap *g* is formed in an equivalent manner.

FIG. 11 (C) shows how the core 134 which is ground or polished in a mirror face manner, is contacted with the core 135 having a non-ground face to form gap *g* in an equivalent manner.

FIG. 11 (D) shows a layer 140 of a weakly magnetic substance, e.g. a paramagnetic or diamagnetic substance, inserted between the cores 136 and 137, the mirror faces of which are ground or polished.

FIG. 11 (E) shows a core 138 provided with a hole 150. The cores of FIGS. 11 (D) and (E) are equivalent to the ones provided with the gap *g*.

FIG. 12 shows an exploded view of an inductor 12 in another embodiment of the present invention. The combined cores 160 and 161 are formed in a cylindrical shape and surround the cylindrical inner coil 162. The core 160 is shaped in a disc form, the core 161 is closed at its one end and has the column core 163 extending axially at the center of the coil 162. The coil 162 surrounds the column core 163 and is contained in the core 161. The magnetic flux caused by the coil 162 passes through the column core 163 and along the circumferential parts of cores 160 and 161. That is, the window 164 in this embodiment is formed around the center. The gap or equivalent spacing g is formed in the opposed parts of the cores 160 and 161 and the column core 163. According to this embodiment the average length of magnetic path *le* of cores 160, 161 and 163 is made still smaller and the core factor is made smaller accordingly, whereby the present invention can be carried out in a more advantageous manner. In addition, the circumferential part of the core is provided, as required, with terminal means for the lead-in wire not shown.

FIG. 13 shows the sectional view of another embodiment of the present invention in which outer and inner cores 176 and 177, respectively, are disassembled. The outer core 176 is cylindrical and its inner face may be ground in a mirror face manner, although it is not necessarily required to do so. The inner core 177 has a section form of a letter H. The non-coiled part of this core 177 may be ground in a mirror face manner, but this is not absolutely necessary. A coil 179 is wound around the annular groove 178 of the inner core 177. The inner core 177 thus formed is fitted along the direction of arrow d into the outer core 176. The inner diameter of the outer core member 176 and the outer diameter of the uncoiled end portions of the inner core member 177 are selected to provide a press-fit between the inner and outer core members.

It is to be noted that the embodiment of FIG. 13 is so structured that the outer core 176 and the inner core 177 contact each other only at the contact faces of the non-coiled end portions of the inner core 177 without a contact at the coiled portion and the area of the contact face is more than 3 times as large as the cross-sectional area of the core of said coiled part. This feature makes the magnetic reluctance smaller. That is, the magnetic reluctance R*o* of the magnetic path formed by the cores 176 and 177 is the sum, as shown by the following equation (6), of the magnetic reluctance R*a* of the contacting portions of cores 176 and 177 and the magnetic reluctance R*b* of the clearance portions.

$$Ro = Ra + Rb = \frac{1}{\mu O \mu ra} \cdot \frac{la}{Aa} + \frac{1}{\mu O \mu rb} \cdot \frac{lb}{Ab} (AT/Wa) \qquad (6)$$

where:

*μO* is the magnetic permeability in the vacuum;

*μra* is the specific magnetic permeability of the cores 176 and 177;

*la* and *lb* are the length of cores 176 and 177 and clearance;

*Aa* and *Ab* are the sectional areas of cores 176 and 177 and clearance; and

*μrb* is specific magnetic permeability in the air.

That is, if the length of clearance b is constant, the magnetic reluctance of clearance Rb can be decreased by increasing the sectional area of clearance Ab. Accordingly, it is possible to increase the sectional area of clearance quite regardless of the sectional area of the coiled part of core 177, and therefore, the magnetic reluctance can be considerably decreased.

FIG. 14 shows a sectional view of still another embodiment of the present invention in which the outer and inner cores 184 and 185, respectively, are disassembled. The outer core 184 is cylindrical and its inner bore is tapered. The inner core 185 has the form of a truncated cone, in which the inside is given the same taper as that of said outer core 184. A coil 181 is wound around the annular groove 186 of the inner core 185. The inner core 185 thus formed is fitted along the direction of arrow *d* into the core 184. The dimensions are again selected to provide for a proper press-fit when inserting the inner core in the direction of the arrow *d*. In both embodiments of FIGS. 13 and 14 the parts may be rotated relative to each other to provide for proper contact even where the core parts have been impregnated for example with varnish.

FIG. 15 is an exploded view of an inductor L2 of still another embodiment of the present invention and FIG. 16 is a sectional view of the inductor L2, as assembled. The inductor L2 is composed of a pair of pot-type cores 200 and 210 and a bobbin 300 on which a coil is wound. The pot-type cores 200 and 210 have a nearly cylindrical form. The bottom 201, 211 supports a pole 202 in the middle of the cylinder. The circumferential wall of each cylinder 200, 201 is provided with a respective slit 203, 213 extending substantially at right angles to the bottom 201, 211.

The bobbin 300 comprises a cylindrical winding core 310 provided with a cylindrical flange 320 and 321 at each end. The terminals 330 and 331 extend in the normal direction away from the flanges 320 and 321. The openings 340, 341 of the coil core 310 in the center of said flanges 320 and 321 are larger in diameter than the pole 202, 212 of the cores 200, 210. The diameter of the flanges 320 and 321 is smaller than the inner diameter of the cores 200, 212. Further, the two terminals 330 and 331 are so designed that they extend in the same direction and are inserted in the slits 203 and 213 of cores 200 and 210. The coil 400 is wound around the coil core 310 and the end of the coil is connected to the terminals 330 and 331. The length of this coiled core 310 in the longitudinal direction is somewhat smaller than the sum of the length of the cores 200 and 210.

Referring to FIGS. 15 and 16 the assembly of the inductor L2 will be described. First, the bobbin 300 is wound with the coil 400 and the coil ends are connected to the terminals 330 and 331, respectively as mentioned. Then the pot-type cores 200 and 210 are inserted from both ends of the bobbin 300 by inserting the poles 202 and 212 of the individual cores 200 and 210 into the openings 340 and 341 of the bobbin 300, whereby the terminals 330 and 331 are aligned with the slits 203 and 213. FIG. 16 shows the assembled inductor in section. In this case the advantages are obtained that the coil ends can be fitted on a printed circuit board with ease and there are no exposed parts to which the high voltage $V_c$ is applied.

Alternatively, the terminals 330 and 331 may be positioned on flanges 320 and 321 extending in a direction parallel to an axial direction of the coiled part 310, and holes may be made in the bottoms 201 and 211 so that the terminals 330 and 331 extend through such holes respectively.

FIG. 17 is a perspective view of the inductor L2 in an embodiment of the core type. One leg of a pair of U-shaped cores 421 composed of a first type of magnetic material having the characteristic C2 shown in FIG. 9, e.g. a ferrite designated as HR3 and made by TDK Electronic Co., Ltd. in Japan, is assembled with one leg of a pair of U-shaped cores 431 composed of a second type of magnetic material having the characteristic d shown in FIG. 9, e.g. a ferrite designated as H5B and also made by the abovementioned company, to form a shell-type core. The coil 440 surrounds the central leg. In this way parallel magnetic paths are formed. The effective permeability $\mu e$ and the maximum magnetic flux density Bm of the finished core depend on the larger characteristic value of either core 421 or 431, and therefore, the effective magnetic permeability $\mu e$ as shown in FIG. 9 by curve C2 is predominant in the range of a low temperature, and the maximum flux density $Bm$ is effective as shown in FIG. 9 by curve d in the range of high temperature.

FIG. 18 shows the inductor L2 in another embodiment of the present invention. A pair of E-shaped cores 422 composed of a magnetic material having the characteristic C2 in FIG. 9 with an effective magnetic permeability $\mu e$, e.g. a ferrite designated as H5C2 made by the abovementioned company and a pair of E-shaped cores 432 composed of a magnetic material having the characteristic curve d of the maximum magnetic flux $B_m$, e.g. a ferrite designated as H7B made by the abovementioned company, are assembled with each other, to form a shell-type core. In the embodiments in FIGS. 17 and 18 the volumetric ratio of the combined cores may be changed, as required, in order to obtain the desired overall temperature characteristic.

Figure 19:
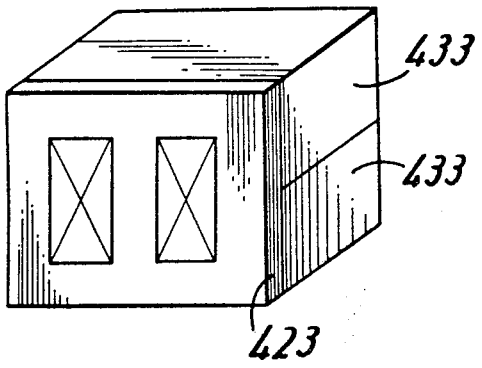

FIG. 19 shows a sectional view of the inductor L2 of a further embodiment of the present invention. The construction of cores of this embodiment is similar to that of FIG. 8, but the core 433 occupying the large volume with one type of ferrite material is composed of a ferrite core with less loss that that of the core portion 423 which is a lamination forming a closed magnetic path in order to diminish the loss of magnetic metal mterial. Such a combination of the core elements has a very large saturation magnetic flux density, i.e. several times as large as that of existing ferrite cores and its Curie temperature is very high.

Figure 20:
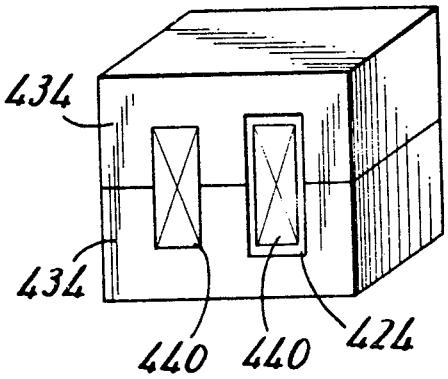

FIG. 20 shows a sectional view of the inductor L2 of a further embodiment of the present invention. A film 424 of magnetic material is provided on the inner circumference of one of the windows formed by a pair of E-shaped cores 434. The cores 434 may be composed of a ferrite designated as H5C2 made by the abovementioned company, and the film 424 may be a magnetic material havng $\mu e$ and $B_m$ a few times as high as those of the ferrite H5C2. The magnetic film 424 may be evaporated to form a closed magnetic path.

The method of evaluating or estimating whether the bounce booster inductor L2 is efficient enough to block the spike voltage $V_{FL}$ at a low temperature will now be described in detail. When the discharge lamp FL is left on, the lamp voltage $V_F$ across the discharge lamp FL is applied to the switching element S except for a period during which the spike voltage $V_{FL}$ is generated, while during that period a voltage of $(V_{FL}-V_D)$, where $V_D$ represents a voltage across the diode S, is applied across the bounce booster inductor L2 whereby a leakage current $I_L$ flows with a phase lag through the inductor L2. If the value of the leakage current $I_L$ exceeds the breakdown current of the switching element S the switching element S is allowed to be on and thus fails to block the spike voltage $V_{FL}$. Therefore, in order to block the spike voltage $V_{FL}$ it is efficient to use a switching element S with a large breakdown current $I_L$ and an inductor L2 whose leakage current $I_L$ is small when the spike voltage $V_{FL}$ occurs. Such an improved inductor L2 has been disclosed hereinabove.

Figure 21:
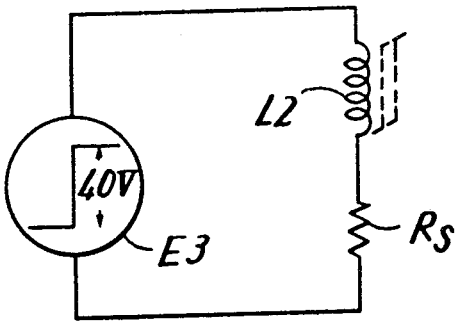
FIG. 21 is a schematic diagram illustrating a circuit for evaluating the leakage current performance of the bounce booster inductor L2.

FIG. 21 shows an evaluating circuit for evaluating the leakage current characteristics of the inductor L2 in order to know whether the spike voltage $V_{FL}$ at a low temperature can be blocked or not. The inductor L2 is connected in series with a power source E3 and a current limiting resistor $R_S$. The power source E3 generates a rapid rising voltage exceeding the voltage value $(V_F - V_D)$ e.g. 40 volts to obtain a rapid saturation of the inductor L2. Resistance of the resistor $R_S$ is selected such that current above the breakdown current level of the thyristor L (e.g. 9 mA) flows through the inductor L2.

Figure 22:
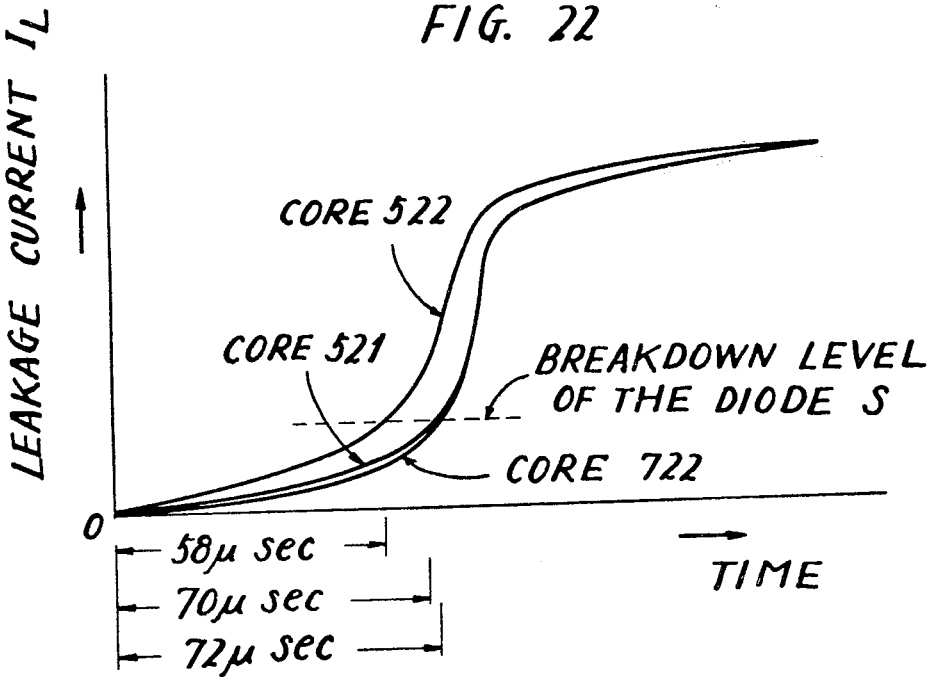
FIG. 22 is an illustration of the leakage current display presented by an oscilloscope cooperating with the circuit of FIG. 21.

FIG. 22 shows the leakage current characteristics of the inductor L2, which is obtained by using the evaluating circuit shown in FIG. 21 on an oscilloscope (not shown). Features of a conventional core 522 and of the improved cores 521 and 722 of the present invention are shown in the following table.

| | Material | Shape | Core factor K | Time up to breakdown level of switching element S |
|---|---|---|---|---|
| (1) Conventional Core 522 | H5B | EE22 | 10 $cm^{-1}$ | 58 μsec |
| (2) Inventive Core 521 | H5B | EE21 | 6 $cm^{-1}$ | 70 μsec |
| (3) Inventive Core 722 | H7B | EE22 | 10 $cm^{-1}$ | 72 μsec |

The materials H5B and H7B are made by the above-mentioned company and the effective permeability $\mu e$ of the material H5B is larger than that of the material H7B. The number of turns N of the coils around cores 522, 521 and 722 is the same, i.e. 200 turns, and the temperature at which such experiments were made is constant, i.e. −10°C, and a time period up to the breakdown level (9mA) after application of the rapid rising voltage from the power source E3 is observed on the oscilloscope. As can be seen, the improved cores 521 and 722 according to the present invention have such characteristics that the current rising below the breakdown level of the switching element S is smaller than that of the conventional core 522, and therefore the time period up to the breakdown level is prolonged.

The effective permeability $\mu e$ of the core material is a function of the leakage current $I_L$ and temperature, and the shape of cores depends largely upon the core factor K $(=\sum_i li/Ai = K_1 + K_2)$.

In particular it is effective to make the core factor K of the core of the coiled part $K_1$ larger than that of the non-coiled part $K_2$ (i.e. $K_1 > K_2$). In other words, an extremely useful inductor is obtained by making the cross-sectional area of the coiled part smaller than that of other parts so that the coiled part is saturated. Therefore, even in the case where the core material has a relatively small permeability, the spike voltage $V_{FL}$ at a low temperature can be blocked by properly selecting the shape of the core as taught herein. In addition, if the material and the shape of the core are improved in combination. the spike voltage $V_{FL}$ at low temperature can be blocked effectively enough even though the core is provided with a gap to start the discharge lamp FL readily at a high temperature.

The blocking operation of the spike voltage $V_{FL}$ is described as follows. When the spike voltage $V_{FL}$ is generated, leakage current $I_L$ through the inductor L2 exceeds a threshold voltage i.e. the breakdown current level of the switching element S, and thus the switching element S is turned on, then the inductor L2 is saturated, and a large current flows through the inductor L2 and the switching element S. It is, therefore, understood that the longer the time period during which the leakage current $I_L$ does not exceed the breakdown current level of the switching element S immediately after the spike voltage $V_{FL}$ is applied to the inductor L2, the greater is the capability of blocking the spike voltage $V_{FL}$ by means of the inductor L2.

Figure 23:
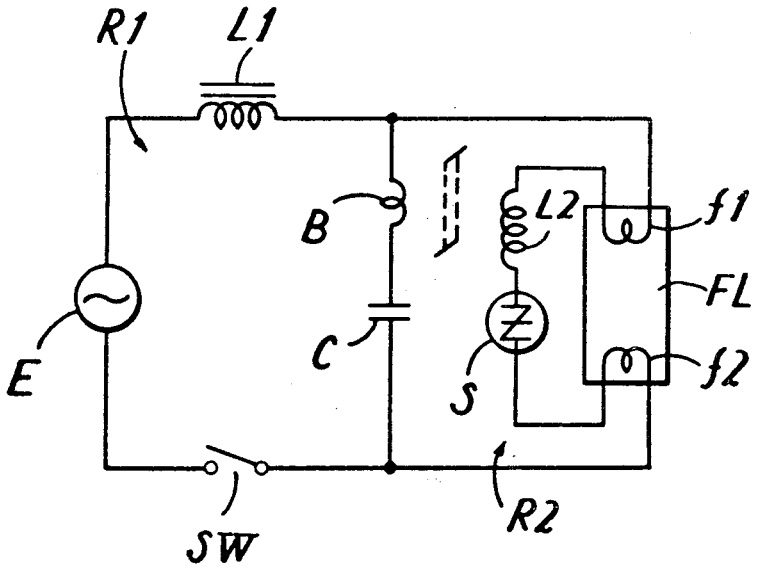
FIG. 23 is a schematic diagram of a modification of FIG. 5.

FIG. 23 illustrates another discharge lamp lighting circuit in accordance with the present invention, which is similar to the embodiment of FIG. 5 except that a bias coil B is provided in series with the capacitor C and coupled magnetically with the inductor L2. The bias coil B gives a magnetic bias to the inductor L2 positively or negatively, so that the bounce voltage across the inductor L2 and thus the oscillation voltage Vc across the capacitor C are adjusted appropriately.

Although specific embodiments of the present invention have been illustrated, it is to be understood that it is intended to cover all modifications and equivalents within the scope of the appended claims.

The embodiments of the invention in which an exclusive property or privelege is claimed are defined as follows:

1. In a discharge lamp lighting apparatus including a first oscillation circuit adapted to be connected to a power source and including a linear inductor and a capacitor connected in series, a second oscillation circuit connected across said capacitor and having a bounce booster saturable inductor and a voltage responsive switching element connected in series, and a third oscillation circuit including said bounce booster saturable inductor and its distributed capacity, whereby a discharge lamp may be connected across said capacitor, said switching element having a breakdown voltage within a range of from above a virtual voltage across said discharge lamp, as lighted, to below the maximum instantaneous voltage of said power source, whereby said first, second and third oscillation circuits generate a high oscillation voltage across said capacitor for starting said discharge lamp; the improvement wherein said bounce booster saturable inductor comprises a magnetic core and a coil, said core having a coiled portion around which said coil is wound, and a non-coiled portion free of said coil, said core having a core factor K defined by the relationship:

$$K = K_1 + K_2$$

where $K_1$ is the core factor of said coiled portion and $K_2$ is the core factor of said non-coiled portion of said core, said core factors $K_1$, $K_2$ having the relationship:

$K_1$ " $K_2$ the cross sectional area of said coiled core portion being less than one half of the cross sectional area of said non-coiled portion, the magnetic path length of said coiled portion being less than one quarter of the overall magnetic path length of said core, whereby when said discharge lamp remains lighted the equivalent inductance of said bounce booster saturable inductor increases to block a peak value of a voltage across said discharge lamp to avoid actuation of said second oscillation circuit and to avoid repetitive unoscillating operation of said discharge lamp.

2. The apparatus according to claim 1, wherein said coiled portion is so formed that its cross section is rectangular, and wherein the thickness of said coiled core portion is larger than the core height or larger than the core width of the coiled core portion.

3. The apparatus according to claim 1, wherein the effective cross sectional area of the magnetic path of said non-coiled core portion is wider than that of the coiled core portion.

4. The apparatus according to claim 1, wherein said magnetic core comprises a ferrite core having a permeability temperature characteristic such that there is at least one permeability peak in the range of −40°C to +10°C.

5. The apparatus according to claim 4, wherein said magnetic core has a higher permeability at a low temperature than at a normal or ordinary temperature.

6. The apparatus according to claim 1, wherein said magnetic core has a window through which said coil is arranged, said window having a height/width ratio in the range of 2.2 to 1 whereby the overall magnetic path length is shortened.

7. The apparatus according to claim 1, wherein the magnetic path of said magnetic core has a gap or equivalent having a gap width in the range of 0.5 to 20 microns, whereby said discharge lamp is started readily at high temperatures.

8. The apparatus according to claim 7, wherein the width of said gap or equivalent is in the range of 1 to 6 microns, whereby said discharge lamp is started readily at high temperatures.

9. The apparatus according to claim 1, wherein said bounce booster inductor is of the core type.

10. The apparatus according to claim 1, wherein said core comprises a bobbin having a cylindrical coiled portion and a pair of wire guiding rods which are positioned on said coiled portion and which extend substantially at a right angle to an axial direction of said coiled portion, said coil being wound around said coiled portion, said coil having free ends which extend individually along said wire guiding rods, said core further including cylindrical outer core means having a bottom, a pole on said bottom, and a slit extending in parallel to the longitudinal core axis, said wire guiding rods being inserted in said slot, and said pole being inserted into said coiled portion of said bobbin, so that said bobbin is integrally secured in said outer core means.

11. The apparatus according to claim 1, wherein said core comprises a bobbin comprising a cylindrical coiled portion and a pair of wire guiding rods which are positioned on said coiled portion and which extend substantially in a direction parallel to an axial direction of said coiled portion, said coil being wound around said coiled portion and having free ends which extend longitudinally along said wire guiding rods said core further including cylindrical outer core means having a bottom, a pole on said bottom, and a pair of holes made in said bottom; said wire guiding rods extending through said holes and said pole being inserted into said coiled portion of said bobbin, so that said bobbin is integrally secured in said outer core means.

12. The apparatus according to claim 1, wherein said core comprises a first core member having a pillar, and including said coiled portion and said noncoiled portion extending in a direction substantially perpendicularly to an axial direction of said coiled portion; said coil being would around said coiled portion, and a second cylindrical core member adapted for insertion of said first core member so that said non-coiled portion is in a close contact with an inner surface area of said second core member, whereby a magnetic circuit is formed therebetween, said contact surface area of said non-coiled portion in contact with said second core member being at least 3 times larger than any cross sectional area of said coiled portion.

13. The apparatus according to claim 1, wherein said core comprises a first core member having a circular truncated conical configuration and having a grooved channel around it, said coil being wound in said grooved channel, and a second cylindrical core member having an inner wall tapered to mate with a non-coiled portion of said first core member.

14. The apparatus according to claim 1, wherein said magnetic core includes a combination of a first magnetic material which has a higher effective permeability at a low temperature than that at a normal temperature and a second magnetic material which has a relatively small reduction of the maximum magnetic flux density at a high temperature than that at a normal temperature, so that said magnetic core has a higher effective permeability at a low temperature than that at a normal temperature, said core further having a relatively larger maximum magnetic flux density at a high temperature as compared to the flux density at low temperature.

* * * * *

UNITED STATES PATENT OFFICE
CERTIFICATE OF CORRECTION

Patent No. 3,942,069 Dated March 2, 1976

Inventor(s) Isao Kaneda

It is certified that error appears in the above-identified patent and that said Letters Patent are hereby corrected as shown below:

Column 21, line 1 change " $K_1$ " $K_2$" to -- $K_1 > K_2$--

Column 22, line 26 change "would" to --wound--

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*